US009433326B2

(12) United States Patent
Dye

(10) Patent No.: US 9,433,326 B2
(45) Date of Patent: Sep. 6, 2016

(54) SOAP DISPENSING RECEPTACLE

(71) Applicant: Charles E. Dye, Hutchinson, KS (US)

(72) Inventor: Charles E. Dye, Hutchinson, KS (US)

( * ) Notice: Subject to any disclaimer, the term of this patent is extended or adjusted under 35 U.S.C. 154(b) by 0 days.

(21) Appl. No.: 14/642,489

(22) Filed: Mar. 9, 2015

(65) Prior Publication Data

US 2015/0182077 A1 Jul. 2, 2015

(51) Int. Cl.

*A47F 7/00* (2006.01)
*A47G 29/087* (2006.01)
*A47K 5/08* (2006.01)

(52) U.S. Cl.

CPC ..... *A47K 5/08* (2013.01); *A47F 7/0035* (2013.01)

(58) Field of Classification Search

CPC ..... A47K 5/08; A47K 5/00; A47K 5/02; A47K 5/03; A47K 5/04; A47K 5/05; A47K 5/18; A47K 5/09; A47J 47/16; A47J 47/20; A47F 7/0021; A47F 7/0028; A47F 7/0035; A47F 1/00; A47F 1/04; A47F 1/12; A47F 5/08; A47F 7/03; A47G 29/00; A47G 29/08; A47G 2400/02

USPC ..... 211/85.12, 119.009, 119.011, 87.01, 211/10; 206/77.1; 4/628; D6/536, 532, 540, D6/529

See application file for complete search history.

(56) References Cited

U.S. PATENT DOCUMENTS 1,057,541 A * 4/1913 Gettins ..... 211/65
2,175,753 A * 10/1939 Guthmann ..... 211/85.12
D146,306 S * 2/1947 Gray ..... D6/536
D188,453 S * 7/1960 Marcus ..... D6/532
3,052,362 A * 9/1962 Bischoff ..... 211/119.009
3,054,211 A 9/1962 Hawk
3,177,048 A 4/1965 Whatley
3,476,254 A * 11/1969 Gaffney ..... 211/85.12
4,313,537 A 2/1982 Collet
4,435,030 A 3/1984 Haven
4,548,572 A * 10/1985 Hoffman ..... 425/410
D286,237 S * 10/1986 Muderlak ..... D6/525
4,630,794 A 12/1986 Ross
D293,638 S * 1/1988 Sussman ..... D6/536
D293,751 S * 1/1988 Sussman ..... D6/536
4,938,345 A * 7/1990 Bolton ..... 206/77.1
5,156,450 A * 10/1992 Lee ..... 312/248
5,181,606 A * 1/1993 Martell ..... 206/77.1
5,242,064 A * 9/1993 Martell ..... 211/85.13
5,255,401 A * 10/1993 Sambrookes et al. ..... 4/605
D359,867 S * 7/1995 Elldrege et al. ..... D6/515
5,509,529 A * 4/1996 Kelley ..... 206/77.1
5,669,085 A * 9/1997 Wilson ..... 4/605
5,680,929 A * 10/1997 Von Seidel ..... 206/77.1

(Continued)

*Primary Examiner* — Jennifer E Novosad

(74) *Attorney, Agent, or Firm* — Kenneth H. Jack; Davis & Jack, L.L.C.

(57) ABSTRACT

A receptacle for receiving and dispensing plurality of soap bars, the receptacle including a first "C" channel and a plurality of second "C" channels, each "C" channel among the first and plurality of second "C" channels having a web member and having a pair of flange members, the flange members being selected from the group consisting of upper flanges, lower flanges, lateral flanges, and oppositely lateral flanges, wherein an uppermost flange among the first "C" channel's flange members comprises the second "C" channels' web members; a plurality of drain ports, each port among the plurality of drain ports opening one of the channels among the plurality of second "C" channels at the one of the channel's web member; and base supports adapted for positioning the first and the plurality of second "C" channels adjacent a sink for soap bar receiving and dispensing use.

8 Claims, 5 Drawing Sheets

(56) References Cited

U.S. PATENT DOCUMENTS

| | | | | | |
|---|---|---|---|---|---|
| D408,187 | S | * | 4/1999 | Forcella, Jr. | D6/540 |
| 5,947,439 | A | | 9/1999 | Florey | |
| 5,984,440 | A | * | 11/1999 | Watson | 312/206 |
| 6,152,294 | A | | 11/2000 | Weinberg | |
| 6,343,845 | B1 | * | 2/2002 | Woodard | 312/248 |
| 7,287,668 | B1 | | 10/2007 | Renaud | |
| 7,424,949 | B2 | | 9/2008 | Kumar | |
| 2007/0095769 | A1 | * | 5/2007 | Jenkins | 211/119.009 |
| 2012/0199604 | A1 | | 8/2012 | Brown | |
| 2015/0182077 | A1 | * | 7/2015 | Dye | 211/85.12 |

* cited by examiner

SOAP DISPENSING RECEPTACLE

FIELD OF THE INVENTION

This invention relates to dishes, racks, and receptacles adapted for use for storage, display, and dispensation of soap bars within bathrooms, washrooms, and kitchens.

BACKGROUND OF THE INVENTION

Commonly configured bar soap trays, dishes, and receptacles often retain moisture at soap supporting surfaces resulting in undesirable water absorption and dissolution of soap bars. Such commonly known soap trays and dispensers further undesirably hold, store, and dispense individual soap bars in a disorganized, unergonomic and inconvenient fashions.

The instant inventive soap dispensing receptacle solves or ameliorates the above described drawbacks and disadvantages of common soap receptacles by configuring the receptacle to include plurality of specialty configured and arranged "C" channels which adapt the receptacle for protecting received soap bars from water dissolution, and which organize and ergonomically dispense soap bars during use and non-use periods.

BRIEF SUMMARY OF THE INVENTION

First structural components of the instant inventive soap bar dispensing receptacle comprises a first and a plurality of second "C" channels. In a preferred embodiment, each "C" channel among the first and plurality of second "C" channels has at least a web member and pair of flange members, the flanges of each such pair preferably cantilevering from opposite ends of the one of the web members. In the preferred embodiment, the flange member "C" channel components of the invention are selected from the group consisting of upwardly positioned and overlying hand space defining flanges, downwardly positioned and lower soap bar supporting flanges, lateral soap bar slot defining flanges, and oppositely lateral soap bar slot defining flanges. In the preferred embodiment, the second "C" channels open upwardly and forwardly, an uppermost flange among the first "C" channel's flange members comprising the second "C" channels' lower web members.

Also in the preferred embodiment of the instant inventive receptacle, each "C" channel among the plurality of second "C" channels is further downwardly opened by a drain port which extends through said each "C" channel's web, each such port communicating with the first "C" channel's forwardly opening space. According to the function of the drain ports, upon receipt and storage of wet soap bars within the second plurality of "C" channels, soapy water from such soap bars may flow downwardly through the ports instead of accumulating within the second "C" channels, such channel draining function advantageously preventing premature dissolution of the soap bars.

Further structural components of the instant inventive receptacle comprise means for positioning the first and the plurality of second "C" channels for soap bar receiving and dispensing use. In the preferred embodiment, such positioning means are connected operatively to a structure selected from the group consisting of the first "C" channel's web member, the first "C" channel's lower flange member, the second "C" channels' web members, and the second "C" channels' flange members. The positioning means may suitably comprise base support extensions which are fixedly attached to and extend downwardly from lateral and oppositely lateral ends of the first "C" channel's lower flange, and such positioning means may further comprise contact feet situated at lower surfaces of such extensions. Alternatively, the positioning means may comprise a suspension loop adapted for engagement with a common shower arm, the suspension loop being fixedly attached to a backing structure attached to rearward aspects of the second "C" channels' web or flange members. The positioning means may further suitably and alternatively comprise wall mount screw receiving eyes which extend through such backing or extend through the first "C" channel's web member. The positioning means may further alternatively comprise adhesive pads. Suitably, the positioning may comprise the entire rearward face of the receptacle, which may rectangularly approximate a bathroom tile or tile series and may be wall mounted in the manner of bathroom tiles. Also suitably, the positioning means may alternatively comprise a whole formation of the receptacle with molded shower stall or bathtub enclosure walls.

In use of the instant inventive soap bar dispensing receptacle, and assuming the selected positioning means comprise base support components as described above, the receptacle may be initially placed upon a sink counter. Where, for example, the receptacle presents four second "C" channels, four different types of soap bars or four different bars designated for different users may be received, organized, and displayed for selection and use within such channels. Upon a need for hand washing, a user may initially wet his or her hands within the sink and may conveniently select and extract one of the soap bars from its second "C" channel. During the user's period of active hand washing use, the selected soap bar may be easily and conveniently inserted into and extracted from the underlying first "C" channel which serves a temporary soap bar storage function. Upon termination of hand washing use of the selected soap bar, the user may re-insert such bar into the previously vacated second "C" channel. Upon re-insertion, soapy water covering such recently used soap bar advantageously flows downwardly onto the web of the second "C" channel, and further flows downwardly through the web's drain port. Such drainage of soapy water from the soap bar advantageously prevents accumulation of the water at and around the contact points between the soap bar and the second "C" channel, advantageously preventing softening and dissolving of the soap bar.

Accordingly, objects of the instant invention include the provision of a receptacle for receiving and dispensing a plurality of soap bars which incorporates structures, as described above, and which arranges those structures in relation to each other in manners described above for the performance of the beneficial functions described above.

Other and further objects, benefits, and advantages of the present invention will become known to those skilled in the art upon review of the Detailed Description which follows, and upon review of the appended drawings.

DETAILED DESCRIPTION OF PREFERRED EMBODIMENTS

Figure 1:
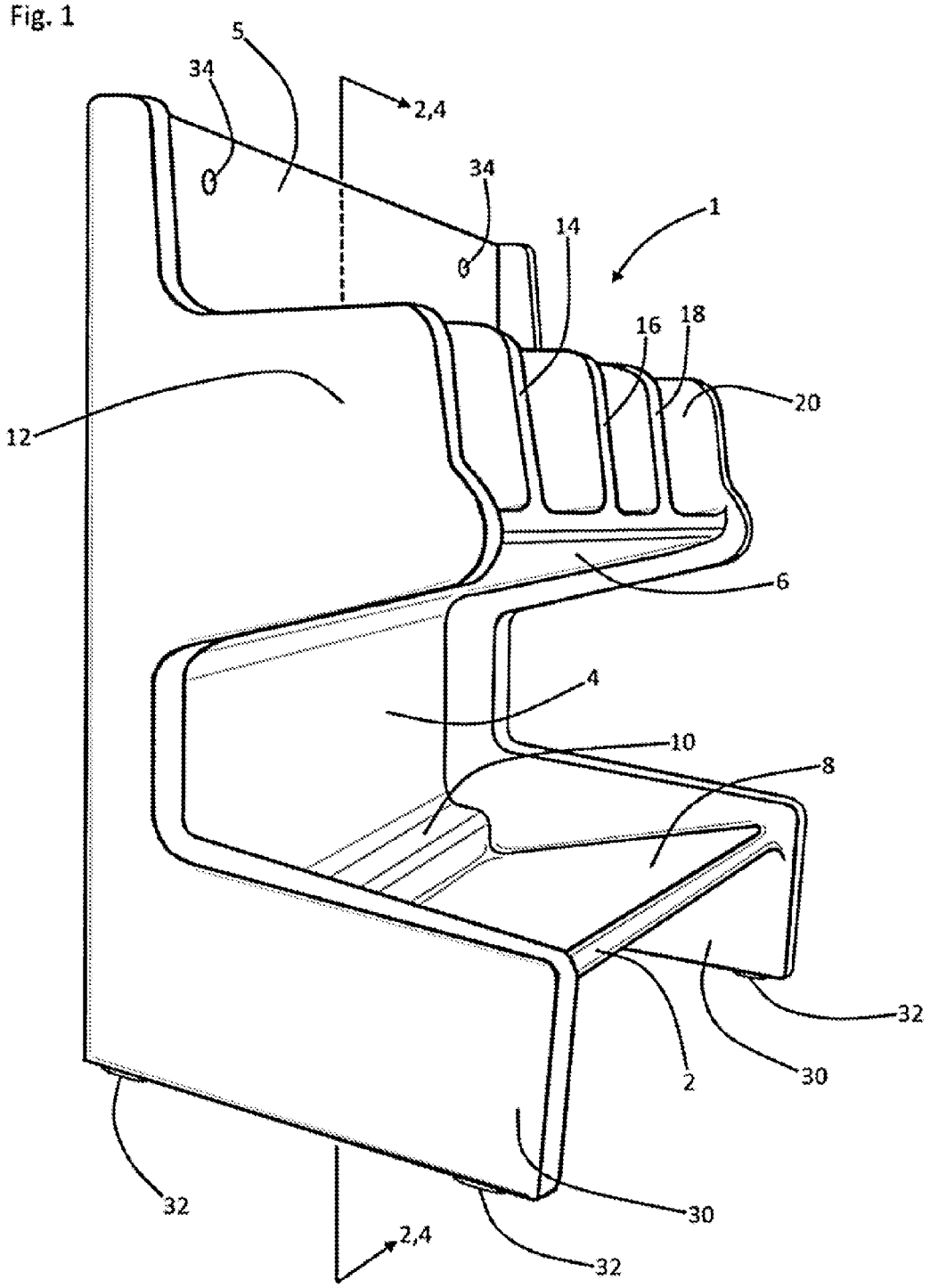
FIG. 1 is a perspective view of the instant inventive receptacle for receiving and dispensing a plurality of soap bars.

Referring now to the drawings and in particular to Drawing FIG. 1, a preferred embodiment of the instant inventive bar soap dispensing receptacle is referred to generally by Reference Arrow 1. The receptacle 1 comprises a first "C" channel member or component comprising a preferably rearwardly positioned and substantially vertically extending web member 4, and paired lower and upper flange members 2 and 6, such flange members respectively forwardly cantilevering from their proximal connections at the upper and lower ends of the web member 4.

Figure 4:
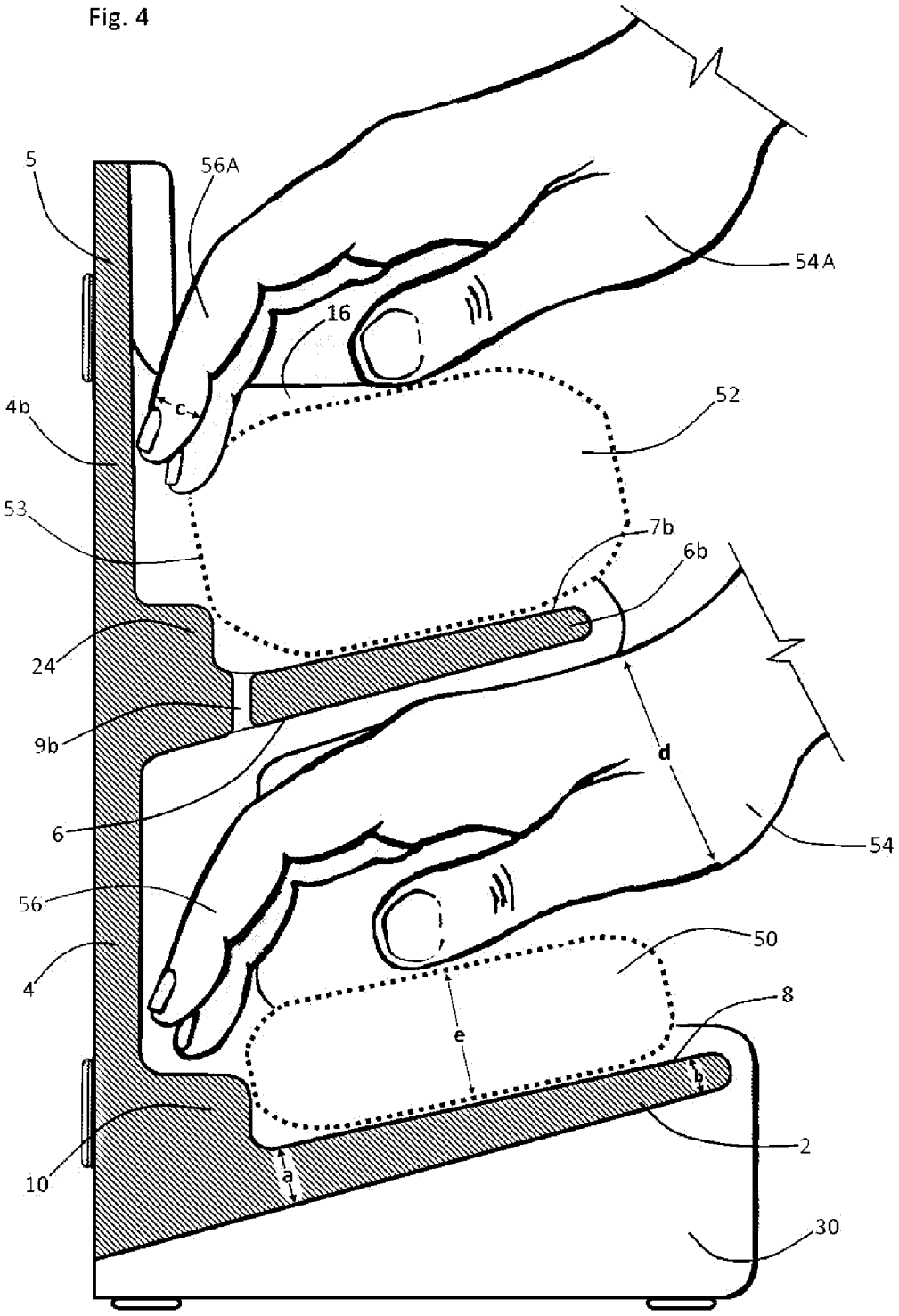
FIG. 4 redepicts the structure of FIG. 2, the view of FIG. 4 further showing inserted soap bars and a user's hand.

In the preferred embodiment, the first "C" member's lower flange 2 slopes upwardly, and has a substantially flat and planar upper surface 8 so that, referring further simultaneously to FIG. 4, upon insertion of a bar of soap 50 into the first "C" channel's forwardly opening space, and upon placement of such soap bar upon surface 8, the soap may easily slide rearwardly within the first "C" channel for secure retention therein.

Figure 2:
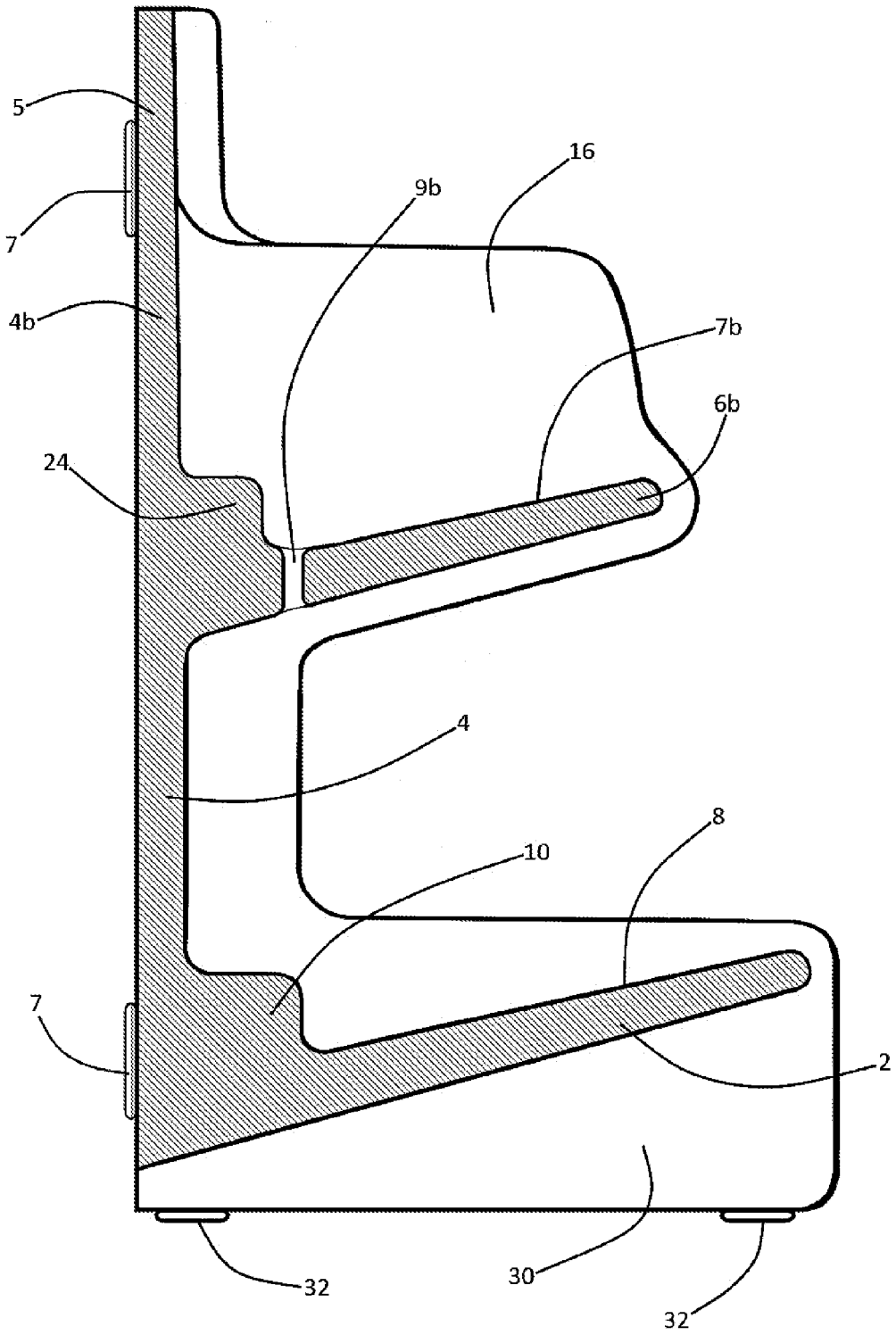
FIG. 2 is a sectional view as indicated in FIG. 1.
Figure 3:
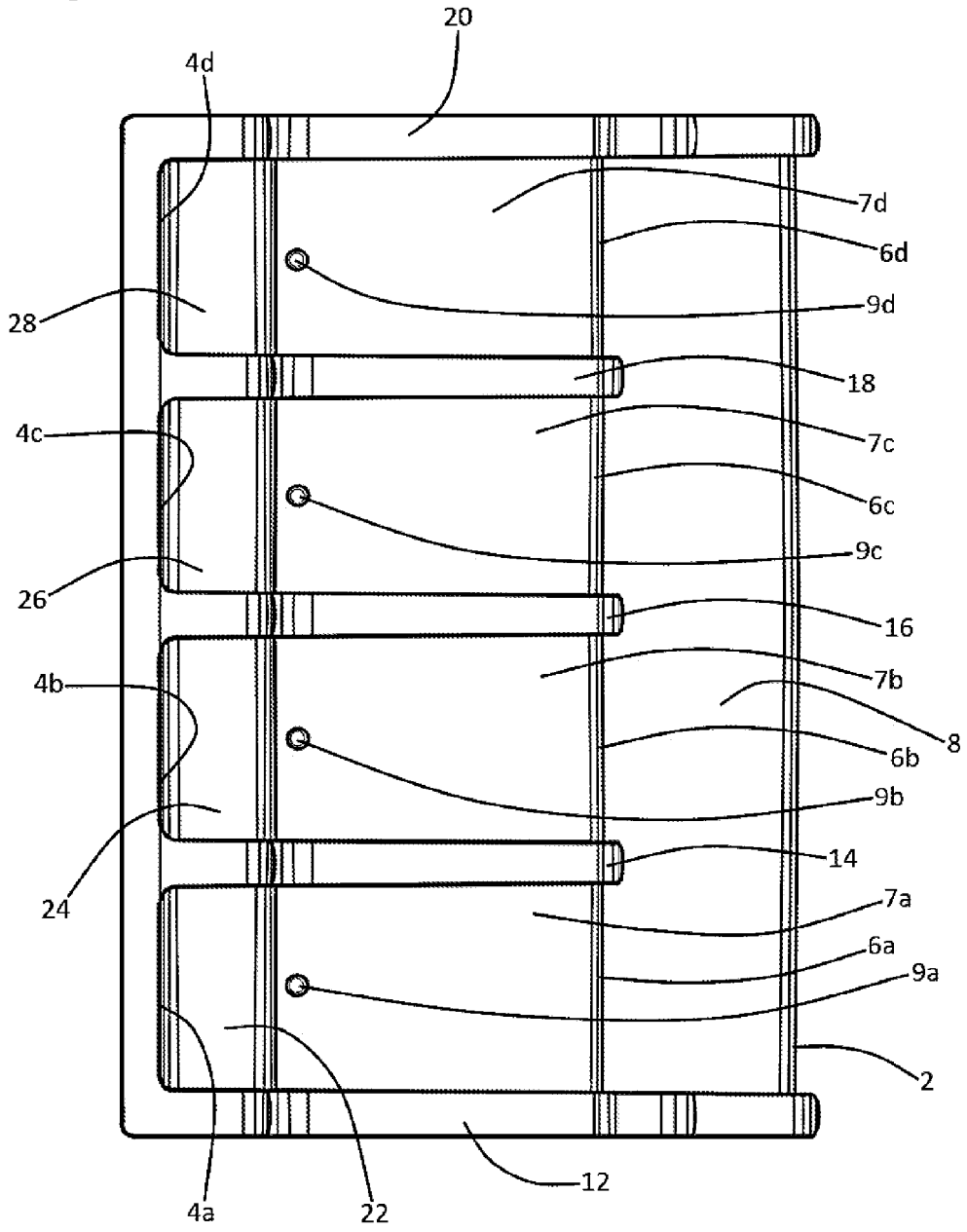
FIG. 3 is an upper plan view of the structure depicted in FIG. 1.

Referring simultaneously to FIGS. 1-3, further structural components of the receptacle 1 comprise a plurality of second "C" channels, each second "C" channel having a web member, 6*a*, 6*b*, 6*c*, or 6*d*, and having a pair of flange members 12 and 14, 14 and 16, 16 and 18, or 18 and 20. In the preferred embodiment, the first "C" channel's upper flange member 6 comprises the second "C" channels' web members 6*a*, 6*b*, 6*c*, and 6*d*, and each of the flange members 12, 14, 16, 18, and 20 extends upwardly from those webs' lateral and oppositely lateral ends to form channel spaces which open at least upwardly. Preferably, each of such channel spaces further opens forwardly.

Referring simultaneously to FIGS. 1-4, each of the second "C" channels' web members 6*a*, 6*b*, 6*c*, and 6*d* preferably slopes upwardly and has a substantially planar slide surface, 7*a*, 7*b*, 7*c*, and 7*d* for, similarly with the function of the first "C" channel's sloped slide surface 8, slideably receiving and securely retaining an assortment of soap bars represented by soap bar 52. Four second "C" channels are depicted in an exemplary fashion in the drawings, and such representation of the plurality of second "C" channels is intended as being representative of alternate provisions of fewer and greater numbers or second "C" channels.

Each of the second "C" channels is preferably further open by a drainage port 9*a*, 9*b*, 9*c*, or 9*d* which respectively extend through rearward and lower or downstream ends of the second "C" channels' web members 6*a*, 6*b*, 6*c*, and 6*d*. In the preferred embodiment, each of the second "C" channels is rearwardly bounded a slide stopping wall 4*a*, 4*b*, 4*c*, or 4*d*, such walls preventing soap bars such as soap bar 52 from sliding rearwardly out of the second "C" channels.

Further structural components of the instant inventive receptacle 1 comprise positioning means which may situate the receptacle for convenient use within environments such as showers, baths, restrooms, washrooms, and kitchens. For use of the receptacle 1 upon counter and ledge surfaces, base extensions 30, which are fixedly attached to and extend downwardly from lateral and oppositely lateral ends of the first "C" channel's flange member 2, may be provided in combination with contact feet 32. In use of such base support positioning means 30, 32, the receptacle 1 may be conveniently placed upon a shelf, counter-top, or ledge adjacent bathtub or wash basin facilities. Suitable alternate positioning means comprise an extension flange 5 which is fixedly attached to and extends upwardly from the upper ends of slide stops 4*a*, 4*b*, 4*c*, and 4*d*, or upwardly from the rearward ends of flanges 12, 14, 16, 18, and 20. Such extension flange 5 suitably includes a plurality of screw receiving eyes 34 which may be utilized for fixedly attaching the receptacle 1 to bathroom wall and shower stall wall surfaces. The eyes 34 may alternatively extend through the first "C" channel's web 4. As an alternative to such screw receiving eyes 34, adhesive pads 7 attached to the receptacle's rearward face may be utilized for such wall mounting. In a further suitable alternative positioning means, the rearward face of the receptacle 1 may be rectangularly configured in a manner consistent with a bathroom or shower stall ceramic tile pattern, such receptacle being attached to the wall as a ceramic fixture in the manner of an adhesively mounted bathroom tile. In a further suitable alternative positioning means, the receptacle may be molded as a part of or formed wholly with a molded shower stall or bathtub enclosure wall.

Figure 5:
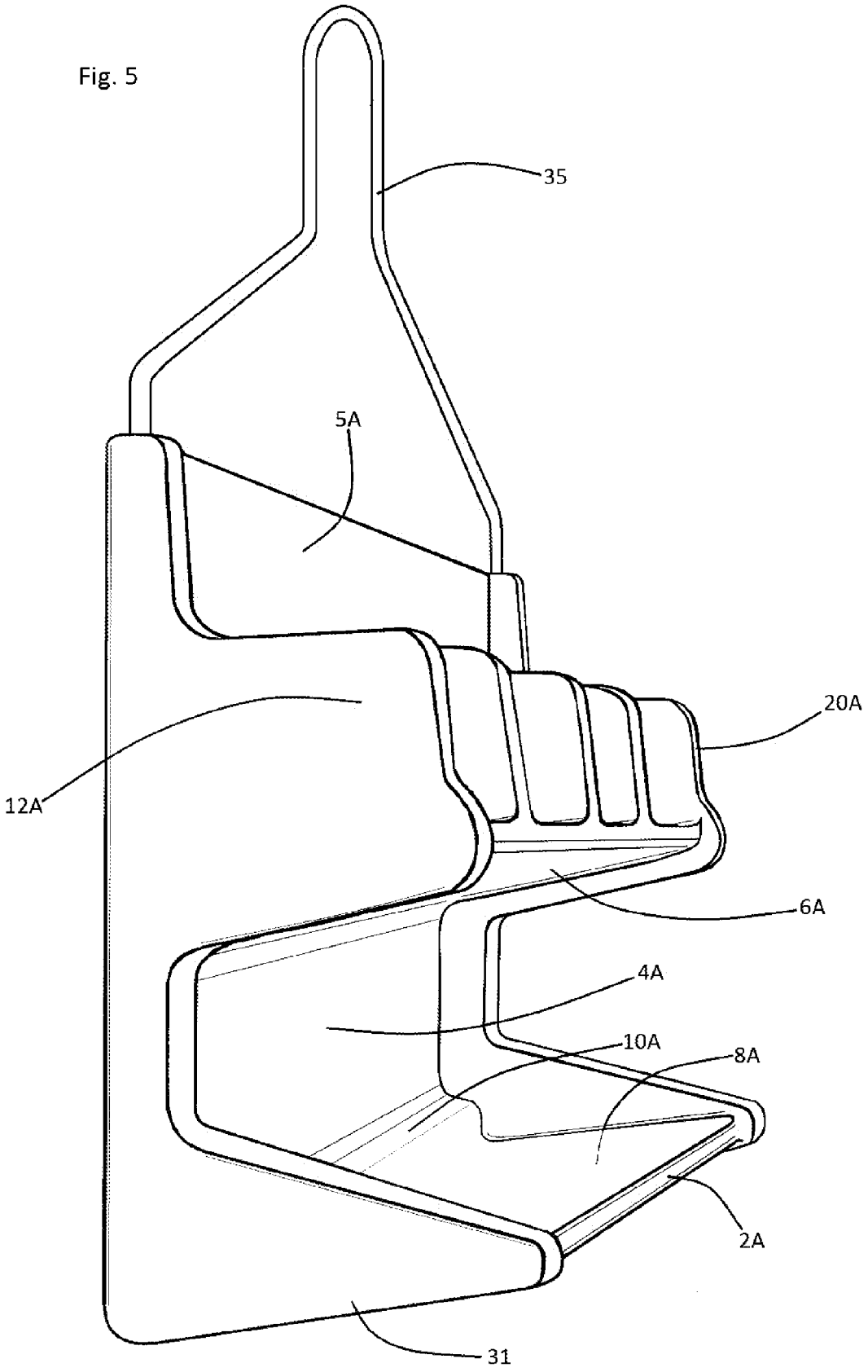
FIG. 5 presents an alternative configuration of the structure depicted in FIG. 1.

FIG. 5 presents a further suitable alternative receptacle positioning means, all reference numerals therein having the suffix "A" being configured substantially identically with similarly numbered structures appearing in FIG. 1. In the FIG. 5 positioning means alternative, a specially configured suspension loop 35 is provided, the lower end of such loop having an open space which is large enough for receipt of a common shower head, and the upper end of the loop 5 being fitted to the tubular profile of a common shower arm.

Where the receptacle 1 comprises molded plastic or porcelain, the lower lateral and lower oppositely lateral ends of the loop 5 are preferably integrally molded within suspension flange 5. Referring in particular to FIG. 4, all of the forwardly extending flange and web members of the receptacle preferably have a relatively thick rearward dimension "a" and a relatively thin forward dimension "b", such sizing of rearward and forward web and flange ends assuring easy rearward extraction of the receptacle from such porcelain or plastic molds. In the FIG. 5 positioning means alternative, the base extension 30 may be eliminated and substituted by a lower edge 31 matching the slope of the first "C" channel's lower flange 2A.

Referring simultaneously to FIGS. 1-4, the instant inventive receptacle 1 preferably further comprises a third "C" channel having a rearward flange and having, upon the first "C" channel's receipt of the exemplary soap bar 50, a forward flange comprising the rearwardly facing surface of such soap bar. In the preferred embodiment, the third "C" channel has a web member comprising a first slide stop extension 10 which is fixedly attached to and extends forwardly from web 4. Upon the preferred incorporation of extension 10, the first "C" channel's web 4 advantageously further functions as the third "C" channel's rearward flange. In the preferred embodiment, the third "C" channel's rearward flange 4 has an upward extension having a vertical dimension which is at least as great as the sum of a common thickness "d" of a user's hand 54 and a common thickness "e" of the exemplary soap bar 50. Such vertical sizing of the third "C" channel's flange 4 in relation to the user's hand 54 and the common soap bar 50 advantageously permits insertions of hands into the forwardly opening first "C" channel for accessing and grasping of soap bars.

Similarly with the hand and soap bar relative sizing of flange 4, the third "C" channel's web/slide stop extension 10 is preferably sized to forwardly extend from flange 4 a distance at least as great as a common finger width "c" so that, upon the first "C" channel insertion of the hand 54, fingers 56 may enter the upwardly opening third "C" channel space between flange 4 and bar 50 for rearwardly hooking the bar 50, and slideably pulling and grasping the soap bar.

Referring further simultaneously to FIGS. 1-4, the instant inventive receptacle 1 preferably further comprises a plurality of fourth "C" channels, each fourth "C" channel having a rearward flange member comprising one of the slide stops 4*a*, 4*b*, 4*c*, or 4*d*. The fourth "C" channels further have, upon slideable receipts of soap bars (exemplified by soap bar 52) within the second "C" channels, forward flanges comprising rearward aspect or surfaces of such soap bars. Similarly with the third "C" channel's lower slide stopping web member 10, each of the fourth "C" channels has a web member comprising an extension stop 22, 24, 26, or 28, such extension stops forwardly extending from their flange members 4*a*, 4*b*, 4*c*, or 4*d*, a distance at least as great as the finger width "c". Such relative sizing of the fourth "C" channels advantageously allows the user's hand 54A to be extended over the soap bars 52 for downward insertions of fingers 56A into a fourth "C" channel for hooking engagement with a selected soap bar.

In use of the instant inventive receptacle 1, and referring simultaneously to FIGS. 1-4, a user may initially place the receptacle upon a counter next to a sink (not depicted within views). Thereafter, the user may insert up to four different types of bars of soap or four bars of soap designated for different users within the four upwardly opening second "C" channels in the manner of the receptacle's exemplary receipt of soap bar 52. Upon such receipt of soap bars, the receptacle advantageously functions as a soap bar storing, sorting, and displaying device which allows the user, upon a subsequent return to the sink, to easily view and select one of the displayed soap bars.

Upon such soap bar selection, the user may position his or her hand 54A over the selected soap bar, bar 52 for example, and may downwardly extend fingers 56A into the corresponding fourth upwardly opening "C" channel, which in the example is defined by stop extension/web member 24, rearward flange/slide stop 4*b*, and the rearwardly facing surface 53 of the soap bar 52. Such downward extensions of fingers 56A is facilitated by the finger admitting dimension of web 24 which is at least as great as that of the fingers' widths "c". Upon the extensions of the fingers 56A behind the soap bar 52, the user may easily and conveniently grasp the soap bar 52 within hand 54A for washing use.

During such washing use of soap bar 52, the soap bar 52 may be intermittently placed into and extracted from the first "C" channel in the depicted manner and position of soap bar 50. Upon completion of such washing use, the user may re-insert the soap bar 52 into the second "C" channel 14, 6*b*, 16. Upon such re-insertion, residual soapy water from the soap bar 52 advantageously drains onto the sloped upper surface 7*b* of web member 6*b*, and emits downwardly through drain port 9*b*. Such sloped surface 7*b* and drain port 9*b* advantageously prevent water accumulation within the second "C" channel and prevent undesirable premature dissolving of the soap bar 52.

The vertical sizing of the first "C" channel to simultaneously accommodate a common hand width "d" and a common soap bar width "e" advantageously further permits easy wash cloth wiping of inner surfaces of the first "C" channel to absorb and remove accumulations of soapy water within the first "C" channel. Transitions between the first slide stop extension 10 and web and flange members 2 and 4 are preferably curved for easy cleaning and wash cloth washing.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope at least commensurate with the appended claims.

The invention hereby claimed is:

1. A receptacle for receiving a plurality of soap bars, each soap bar having a vertical height, the receptacle comprising:

(a) a first "C" channel and a plurality of second "C" channels, the first "C" channel opening forwardly and each of the second "C" channels opening upwardly, each of the first and plurality of second "C" channels having a web member and having a pair of flange members, one of the first "C" channel's flange members being positioned above the first "C" channel's other flange member, wherein said one flange member comprises the second "C" channels' web members;

(b) a plurality of ports, each of the ports draining one of the second "C" channels; and (c) means for positioning the first and the plurality of second "C" channels for use, said means being connected operatively to at least a first member selected from the group consisting of the first "C" channel's web member, the first "C" channel's flange members, the second "C" channels' web members, and the second "C" channels' flange members;

wherein each of the first "C" channel's flange members extends forwardly, wherein each of the first "C" channel's flange members slopes upwardly, and wherein the second "C" channels further open forwardly.

2. The receptacle of claim 1 further comprising a plurality of upper soap slide stops, the upper soap slide stops being positioned at rearward ends of the second "C" channels.

3. The receptacle of claim 2 further comprising a third "C" channel and a plurality of fourth "C" channels, each "C" channel among the third and plurality of fourth "C" channels having a web member and having, upon receipts of soap bars within the first and plurality of second "C" channels, front and rear flange members, the front flange member of each "C" channel among the third and plurality of fourth "C" channels comprising one of the received soap bars.

4. A receptacle for receiving a plurality of soap bars, each soap bar having a vertical height, the receptacle comprising:

(a) a first "C" channel and a plurality of second "C" channels, the first "C" channel opening forwardly and each of the second "C" channels opening upwardly, each of the first and plurality of second "C" channels having a web member and having a pair of flange members, wherein the first "C" channel's flange members extend forwardly and upwardly, wherein one of the first "C" channel's flange members is positioned above said "C" channel's other flange member, and wherein said one flange member comprises the second "C" channels' web members;

(b) a plurality of ports, each of the ports draining one of the second "C" channels;

(c) means for positioning the first and the plurality of second "C" channels for use, said means being connected operatively to at least a first member selected from the group consisting of the first "C" channel's web member, the first "C" channel's flange members, the second "C" channels' web members, and the second "C" channels' flange members;

(d) a plurality of upper soap slide stops positioned at rearward ends of the second "C" channels;

(e) a third "C" channel and fourth "C" channels having web members and having, upon receipts of soap bars within the first and plurality of second "C" channels, front and rear flange members, the front flange members of the third and fourth "C" channels comprising the soap bars; and (f) a lower stop extension and a plurality of upper stop extensions, the lower and plurality of upper stop extensions respectively extending from the first "C" channel's web and the upper soap slide stops, the third "C" channel's web member comprising the lower stop extension and the fourth "C" channels' web members comprising the upper slide stop extensions.

5. The receptacle of claim 4 wherein the means for positioning the first and the plurality of second "C" channels for the soap bar receiving and dispensing use comprise a supporting member adapted for positioning the first and plurality of second "C" channels at a surface selected from the group consisting of counters, ledges, shelves, bathroom walls, shower stall walls, and showerhead arms.

6. The receptacle of claim 5 wherein the first "C" channel's web member has a vertical height, said web member's vertical height being at least as great as one of the soap bar's vertical heights.

7. The receptacle of claim 6 wherein each of the upper stop extensions extends forwardly from one of the upper slide stops, the upper stops' forward extensions defining finger insertion spaces.

8. The receptacle of claim 7 wherein each of the first and plurality of second "C" channels' flange members comprises injection molded plastic or porcelain and has rearward and forward ends, the rearward end of each of the first and plurality of second "C" channels' flange members having a thickness dimension greater than that of said each flange's forward end.

* * * * *